US008978631B2

(12) United States Patent
Shudo et al.

(10) Patent No.: US 8,978,631 B2
(45) Date of Patent: Mar. 17, 2015

(54) ENGINE EQUIPPED WITH BREATHER MECHANISM

(75) Inventors: Shigeru Shudo, Wako (JP); Ryo Saito, Wako (JP); Noboru Kawaguchi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 308 days.

(21) Appl. No.: 12/905,630

(22) Filed: Oct. 15, 2010

(65) Prior Publication Data

US 2011/0088641 A1 Apr. 21, 2011

(30) Foreign Application Priority Data

Oct. 19, 2009 (JP) ..... 2009-240807

(51) Int. Cl.
*F01M 13/00* (2006.01)
*F01M 13/02* (2006.01)

(52) U.S. Cl.
CPC ..... *F01M 13/00* (2013.01); *F01M 13/022* (2013.01); *F01M 13/023* (2013.01); *F01M 2013/0044* (2013.01)
USPC ..... 123/572; 123/41.86

(58) Field of Classification Search
USPC ..... 123/41.86, 572, 574
See application file for complete search history.

(56) References Cited

U.S. PATENT DOCUMENTS

| | | | | |
|---|---|---|---|---|
| 4,103,650 | A | 8/1978 | Nishida et al. | |
| 5,027,784 | A | 7/1991 | Osawa et al. | |
| 5,794,602 | A * | 8/1998 | Kimura | 123/572 |
| 5,947,068 | A * | 9/1999 | Araki | 123/90.31 |
| 6,021,766 | A * | 2/2000 | Maeda et al. | 123/573 |
| 6,412,478 | B1 * | 7/2002 | Ruehlow et al. | 123/572 |
| 6,439,215 | B1 * | 8/2002 | Sato et al. | 123/572 |
| 6,644,290 | B2 * | 11/2003 | Yoneyama et al. | 123/572 |
| 6,830,041 | B2 | 12/2004 | Kusaka | |
| 7,246,611 | B2 * | 7/2007 | Mashiko | 123/572 |
| 8,123,829 | B2 * | 2/2012 | Sato et al. | 55/385.3 |
| 2004/0016423 | A1 | 1/2004 | Kusaka | |

FOREIGN PATENT DOCUMENTS

| | | | |
|---|---|---|---|
| EP | 1 179 658 | A1 | 2/2002 |
| JP | 2000-045747 | A | 2/2000 |
| JP | 2003-129820 | A | 5/2003 |
| JP | 2004-060531 | A | 2/2004 |

OTHER PUBLICATIONS

European Search Report dated Apr. 11, 2011, issued in corresponding European Patent Application No. 10187355.2.
Notification of Reason for Refusal dated Oct. 2, 2012, issued in corresponding Japanese Patent Application No. 2009-240807, with Partial English translation (4 pages).

* cited by examiner

*Primary Examiner* — Noah Kamen
*Assistant Examiner* — Grant Moubry
(74) *Attorney, Agent, or Firm* — Westerman, Hattori, Daniels & Adrian, LLP

(57) ABSTRACT

Breather mechanism includes a breather passage opening into a crankcase, a breather chamber communicating with the crankcase via the breather passage, and a valve provided in the breather chamber and openable to allow blow-by gas to flow from the crankcase into the breather chamber once inner pressure of the crankcase exceeds a predetermined value. When the engine is placed in a laterally laid-down position, entry, into the breather chamber, of lubricating oil is prevented by the breather passage. When the engine is placed in a vertically upright position, an outlet end portion of the breather passage is located above an inlet end portion of the breather passage.

7 Claims, 13 Drawing Sheets

10
87
86
4
P1
26
85
6
67
67a
68
42
43
52a
65a
51
25
58b
58
32
21
65
5
57
53
71
44
31
58c
56
H1
61
52b
62
52
63
77
5
82
37a
33
33a
81
81a
54
41
24
L1
35
4
37

ENGINE EQUIPPED WITH BREATHER MECHANISM

FIELD OF THE INVENTION

The present invention relates to an engine in which lubricating oil is stored in a crankcase and which includes a breather mechanism for causing blow-by gas of the crankcase to flow out of the crankcase. Such an engine will hereinafter sometimes be referred to as "breather-mechanism-equipped engine".

BACKGROUND OF THE INVENTION

In engines, gas of a combustion chamber flows through a gap between an engine cylinder and a piston into a crankcase as blow-by gas. Many of the engines include a breather device for causing the blow-by gas to flow out of the crankcase and then return to the combustion chamber, as disclosed for example in Japanese Patent No. 4089334. According to the breather device disclosed in the 4089334 patent, once the inner pressure of the crankcase exceeds a predetermined pressure due to the blow-by gas, a breather valve (lead valve) of the breather device opens, so that the blow-by gas is sucked into an air intake system via a breather passage. The blow-by gas thus sucked into the air intake system is returned back to the combustion chamber of the engine.

For stability during transportation or storage of the engine, it is sometimes desired that the engine be retained in a laterally laid-down position, i.e. in a position where the engine cylinder lies sideways. However, the engine disclosed in the 4089334 patent is constructed for use in a vertically upright position (i.e., position where the engine cylinder is located in an upper region of the engine). Thus, when the engine is placed in the laterally laid-down position, lubricating oil stored in the crankcase may enter the breather passage. Consequently, if the engine is driven after (particularly, immediately after) the engine is returned from the laterally laid-down position to the vertically upright position, the lubricating oil staying in the breather passage may be undesirably sucked into an air intake system of the engine.

SUMMARY OF THE INVENTION

In view of the foregoing prior art problems, it is an object of the present invention to provide an improved breather-mechanism-equipped engine which can reliably prevent lubricating oil from being sucked into the air intake system as the engine is driven after (particularly, immediately after) the engine is returned to the vertically upright position from the laterally laid-down position intended for transportation or storage of the engine.

In order to accomplish the above-mentioned object, the present invention provides an improved engine in which lubricating oil is stored in a crankcase and which is equipped with a breather mechanism for causing blow-by gas of the crankcase to flow out of the crankcase, the breather mechanism comprising: a breather passage opening into the crankcase; a breather chamber communicating with the crankcase via the breather passage; and a breather valve provided at an inlet of the breather chamber, the breather valve being openable to allow the blow-by gas to flow out of the crankcase into the breather chamber via the breather passage once inner pressure of the crankcase exceeds a predetermined value. When the engine is placed in a laterally laid-down position, entry, into the breather chamber, of the lubricating oil is preventable by the breather passage. When the engine is placed in a vertically upright position, an outlet end portion of the breather passage, opening into the breather chamber, is located above an inlet end portion of the breather passage opening into the crankcase.

According to the present invention, when the engine is placed in the laterally laid-down position that is intended for transportation, storage, etc. of the engine, the lubricating oil can be reliably prevented by the breather passage from entering the breather chamber. When the engine is in the laterally laid-down position, the inlet end portion of the breather passage, opening into the crankcase, may be immersed in the lubricating oil stored in the crankcase. If the engine is returned from such a laterally laid-down position back to the vertically upright position, the lubricating oil would stay in the inlet end portion, so that the lubricating oil may be undesirably directed by the blow-by gas to the breather chamber. To avoid such an inconvenience, the outlet end portion of the breather passage in the present invention is disposed above (higher than) the inlet end portion when the engine is in the vertically upright position.

As known, the lubricating oil has a greater specific gravity than the blow-by gas, and thus, the residual lubricating oil staying in the inlet end portion cannot be lifted up to the outlet end portion by the blow-by gas. In this way, it is possible to reliably prevent a portion of the residual lubricating oil, staying in the inlet end portion, from entering the breather chamber and thereby prevent the lubricating oil from being sucked into the air intake system.

Meanwhile, the remaining portion of the residual lubricating oil is directed, together with the blow-by gas, to the outlet end portion via the breather passage, from which it further flows into the breather chamber via the opened breather valve.

Because the breather chamber has a greater space than the breather passage, the flow speed of the blow-by gas, having flown into the breather chamber, would decrease, so that the residual lubricating gas, having flown into the breather chamber together with the blow-by gas, is separated from the blow-by gas and drops down to a lower portion of the breather chamber. Thus, the residual lubricating oil, having flown into the breather chamber, can be prevented from being sucked into the combustion chamber of the engine, so that only the blow-by gas can be sucked into the combustion chamber.

Preferably, when the engine is placed in the laterally laid-down position lying on its one side (e.g., front side), the breather chamber is located above an engine block (and hence the crankcase), and the inlet end portion of the breather passage is immersed in the lubricating oil. Thus, if the engine is returned from the laterally laid-down position back to the vertically upright position, the lubricating oil would stay in the inlet end portion. According to the present invention, as noted above, the outlet end portion of the breather passage is disposed above (higher than) the inlet end portion when the engine is in the vertically upright position. Further, because the lubricating oil has a greater specific gravity than the blow-by gas, the residual lubricating oil staying in the inlet end portion cannot be lifted up to the outlet end portion by the blow-by gas. In this way, it is possible to prevent the residual lubricating oil, staying in the inlet end portion, from entering the breather chamber and thereby prevent the lubricating oil from being sucked into the air intake system.

Preferably, when the engine is placed in the laterally laid-down position lying on its another side (e.g., back side) opposite from the one side, the breather chamber is located below the engine block (and hence the crankcase), and the inlet end portion of the breather passage is located above the lubricating oil stored in the crankcase. This arrangement can prevent the lubricating oil from entering the breather passage via the inlet end portion. In this way, it is possible to prevent the residual lubricating oil from entering the breather chamber and thereby prevent the lubricating oil from being sucked into the air intake system.

Preferably, the breather valve includes a valve seat, and a valve body formed of an elastic material into a dome shape and mounted on the valve seat, the valve seat having a valve passage normally closed with the valve body. Thus, once the inner pressure of the crankcase (i.e., pressure of the blow-by gas) exceeds the predetermined value, the breather valve can be efficiently elastically deformed to allow the blow-by gas to efficiently flow out of the crankcase to the breather chamber.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
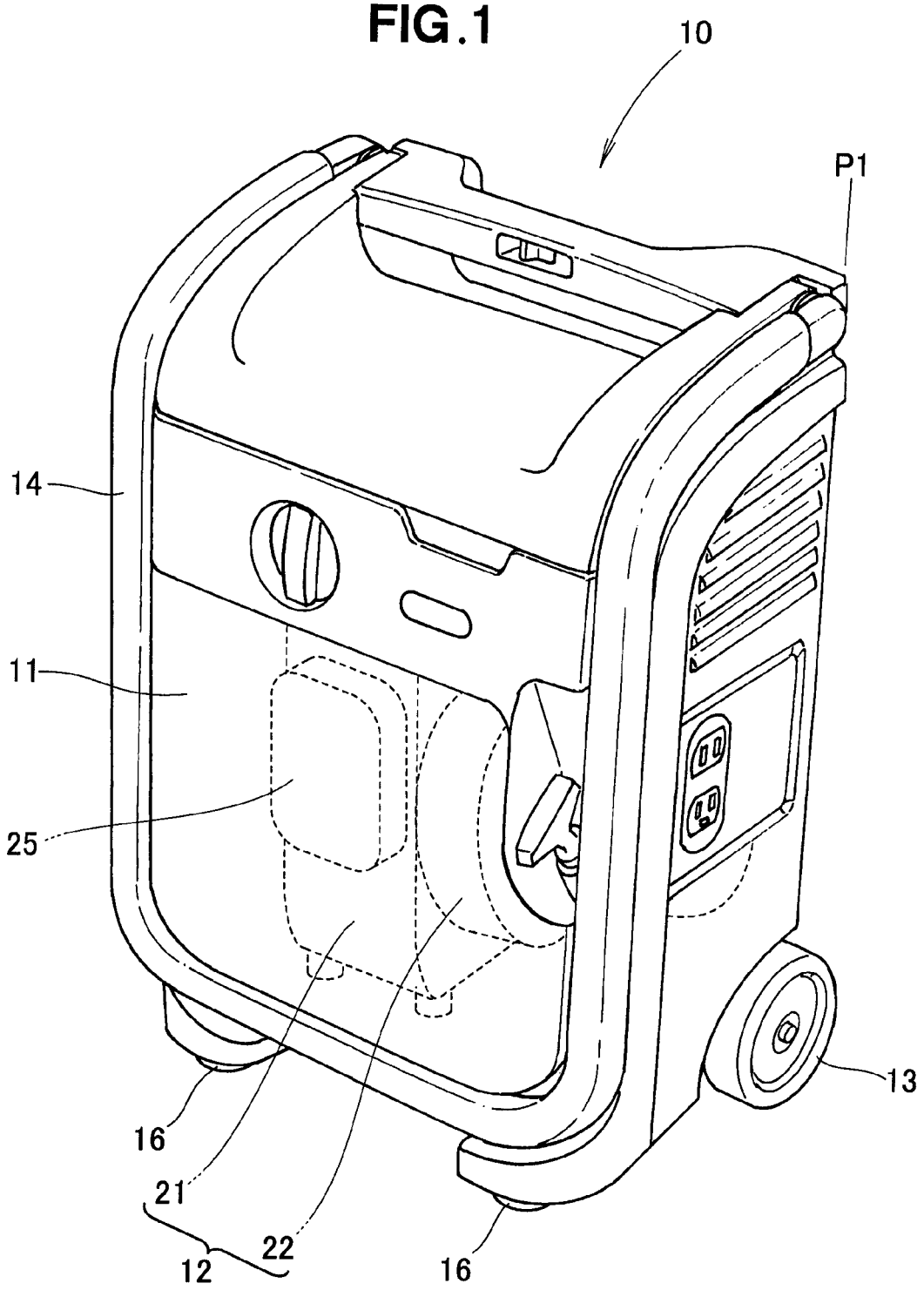
FIG. 1 is an overall perspective view of a power generator including a breather-mechanism-equipped engine according to a first embodiment of the present invention.
Figure 2:
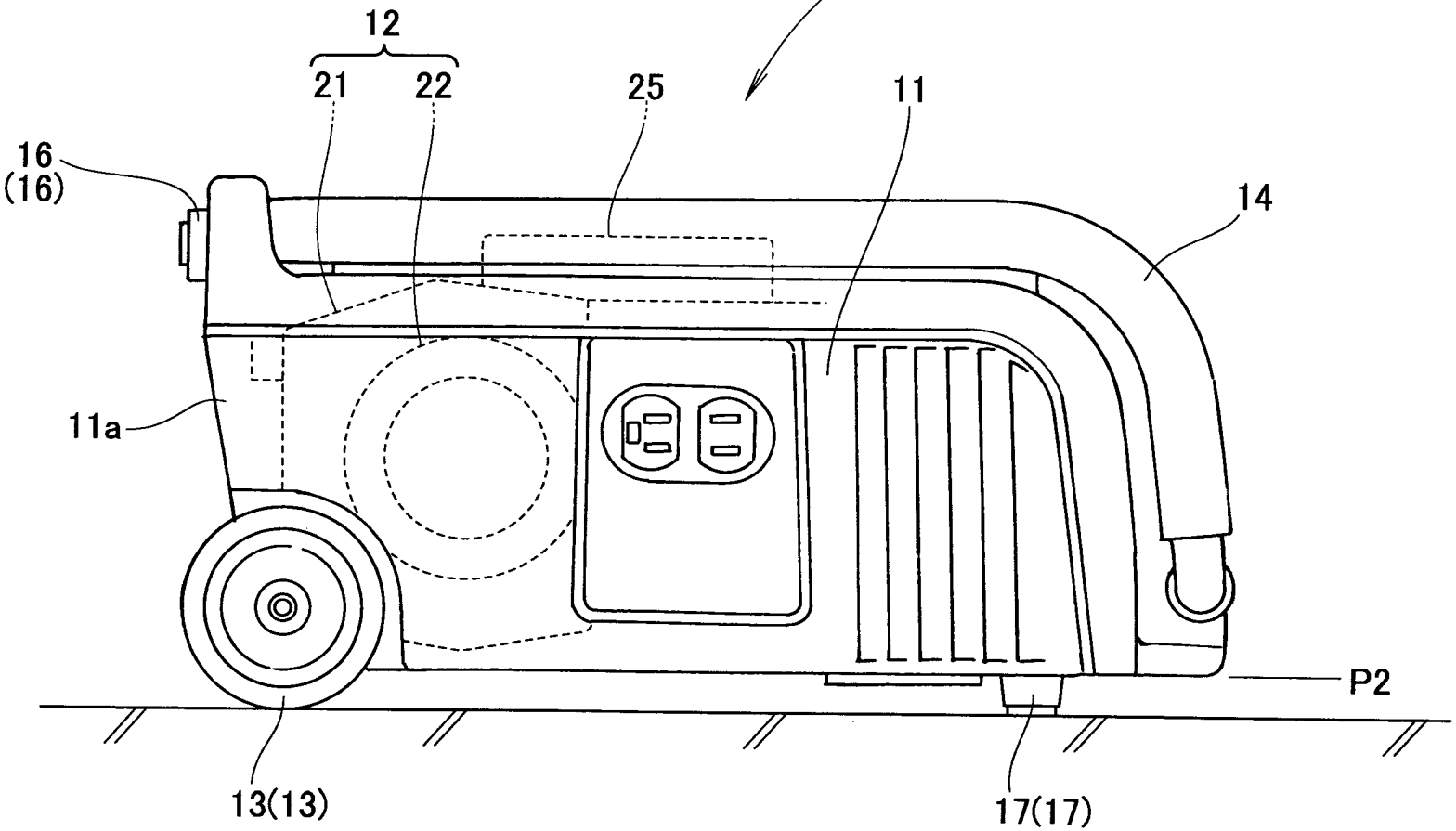
FIG. 2 is a side view of the power generator of FIG. 1 placed in a laterally laid-down position.

FIG. 1 is an overall perspective view of a power generator 10 including an engine 21 equipped with a first embodiment of a breather mechanism, and FIG. 2 is a side view of the power generator 10 shown in FIG. 1. As shown in FIGS. 1 and 2, the power generator 10 includes: a housing case 11 having a substantially rectangular parallelepiped contour or shape; an engine/generator unit 12 accommodated in the case 11; left and right wheels 13 rotatably mounted on the case 11; and a towing handle 14 pivotably mounted on the case 11.

The power generator 10 is towable via the left and right wheels 13 by a user or human operator pivoting the handle 14 upward and pulling the pivoted handle 14. Further, the power generator 10 can be retained in a vertically upright position P1 by means of the left and right wheels 13 and left and right lower foot portions 16. The vertically upright position P1 is where a cylinder 42 (FIG. 3) of an engine 21 is located in an upper region of the power generator 10 and hence engine 21. With the power generator 10 placed in such a vertically upright position P1, the engine/generator unit 12 can be driven.

Furthermore, the power generator 10 can also be retained in a laterally laid-down position P2 lying on its front side (i.e., front side as viewed in the towing direction of the power generator 10) by means of the left and right wheels 13 and left and right upper foot portions 17, as shown in FIG. 2. Such a position P2 is where the engine cylinder 42 lies sideways and will hereinafter be referred to as "forward laterally-laid-down position P2". With the power generator 10 (and hence the engine 21) placed in such a laterally laid-down position P2, the power generator 10 (and hence the engine 21) can be retained stably during transportation, storage, etc. thereof.

The engine/generator unit 12 comprises an integral combination of the engine 21 mounted on a bottom portion 11*a* of the case 11 and a power generation section 22 drivable by the engine 21. In the engine/generator unit 12, the engine 21 rotates the rotor of the power generation section 22 around the outer periphery of the stator so that electric power can be generated.

Figure 3:
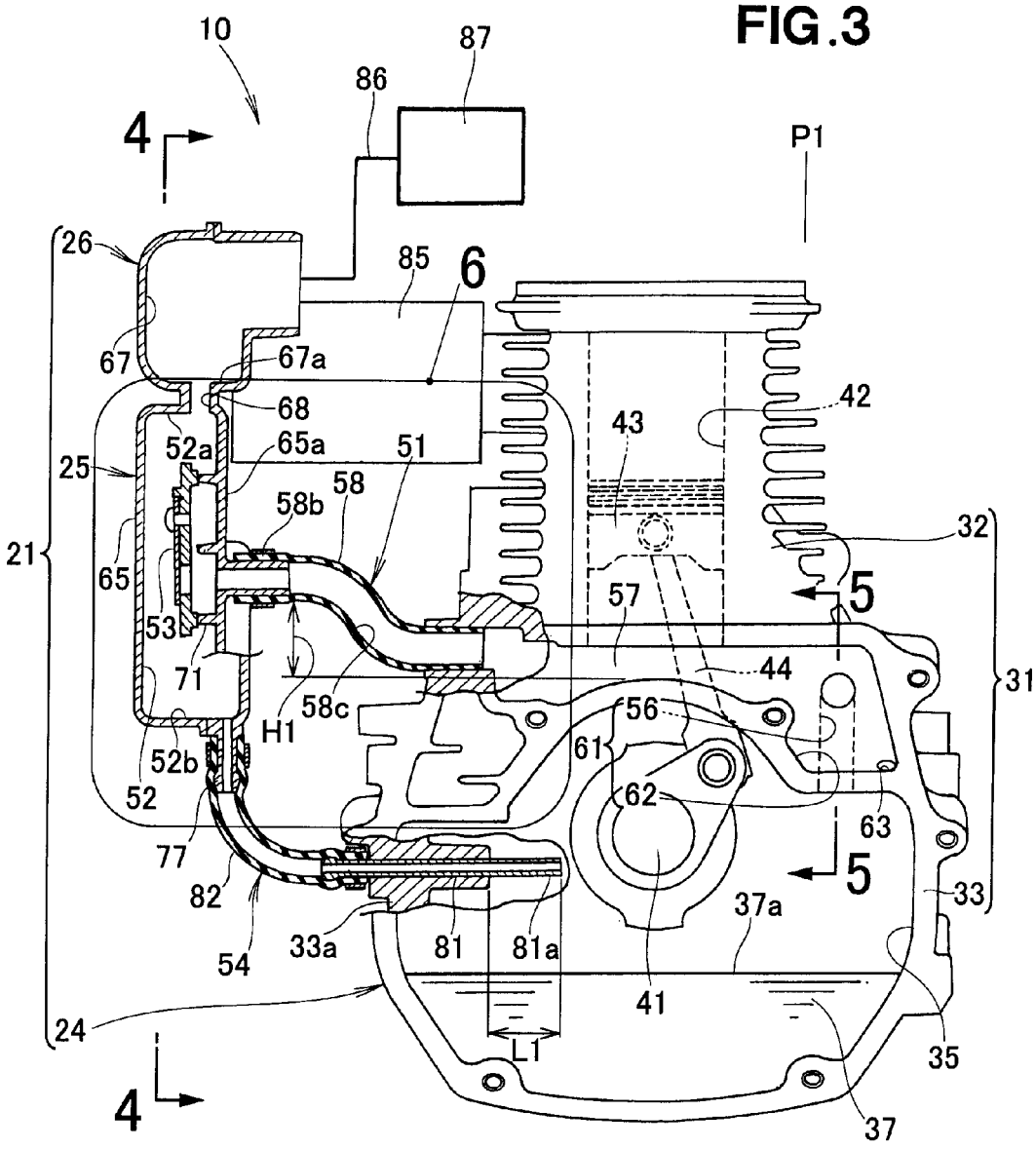
FIG. 3 is a sectional view showing the breather-mechanism-equipped engine.
Figure 4:
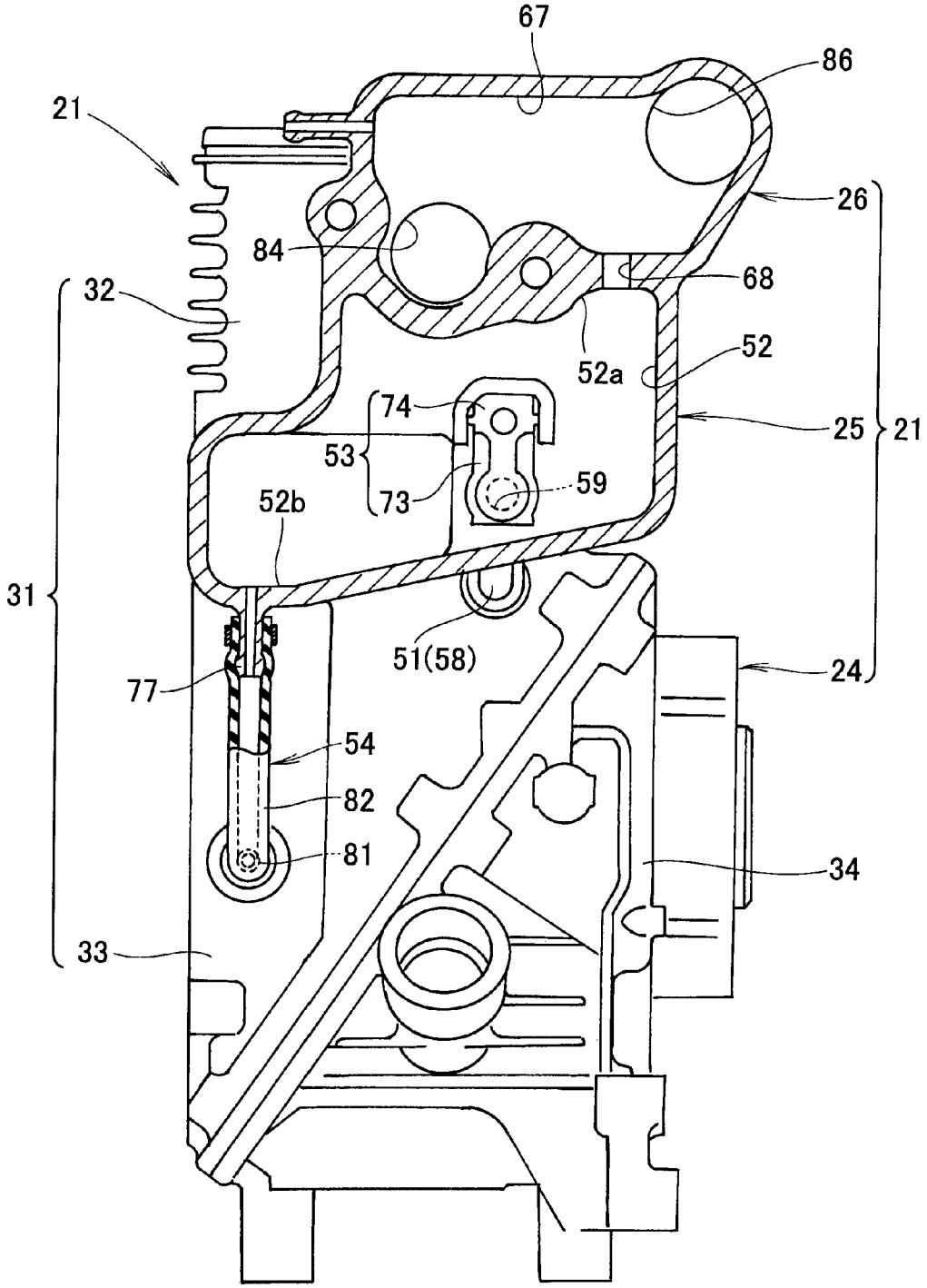
FIG. 4 is a sectional view taken along line 4-4 of FIG. 3.

As shown in FIGS. 3 and 4, the engine 12 is, for example, a four-cycle, single-cylinder engine which includes an engine body 24, a breather mechanism 25 provided on the engine body 24, and an air intake system 26 provided in fluid communication with the breather mechanism 25.

The engine body 24 includes an engine block 31 integrally having a cylinder section 32 and a case section 33, and a crank case section 34 (FIG. 4) fixedly attached to the case section 33. A crankcase 35 is constructed, in a hermetically sealed state, of the case section 33 and crank case section 34.

Lubricating oil 37 is stored in the crankcase 35, and the lubricating oil 37 is supplied, for example, to sliding components in the engine 21 to secure fluid lubrication of sliding surfaces of the components to thereby minimize friction between the sliding surfaces.

Further, the engine body 24 includes a crankshaft 41 rotatably mounted in the crankcase 35, a piston 43 slidably mounted in a cylinder 42 of the cylinder section 32, and a connecting rod 44 connecting between the piston 43 and the crankshaft 41.

A combustion chamber is provided in an upper region of the cylinder 42. During operation of the engine 21, gas of the combustion chamber flows through a gap between the cylinder 42 and the piston 43 into the crankcase 35 as blow-by gas.

FIG. 3 shows the breather-mechanism-equipped engine 21 with the crank case section 34 detached therefrom to ease understanding of the construction of the engine 21. The breather mechanism 25 is provided in the engine block 31.

The breather mechanism 25 includes: a breather passage 51 communicating with the crankcase 35; a breather chamber 52 communicating with an outlet end portion 58*b* of the breather passage 51 opening into the breather chamber 52; a breather valve 53 disposed on an inlet end portion 59 of the breather chamber 52; and a main return passage 54 for returning the lubricating oil 37, having flown into the breather chamber 52, back to the crankcase 35.

The breather passage 51 includes first to third breather passage sections 56, 57 and 58. The first breather passage section 56 is formed in the case section 33 for communicating between the crankcase 35 and the second breather passage section 57. The second breather passage section 57 is provided in the case section 33 for communicating between the first breather passage section 56 and the third breather passage section 58. The third breather passage section 58 extends backward from the case section 33 for communicating between the second breather passage section 57 and the breather chamber 52.

Figure 5:
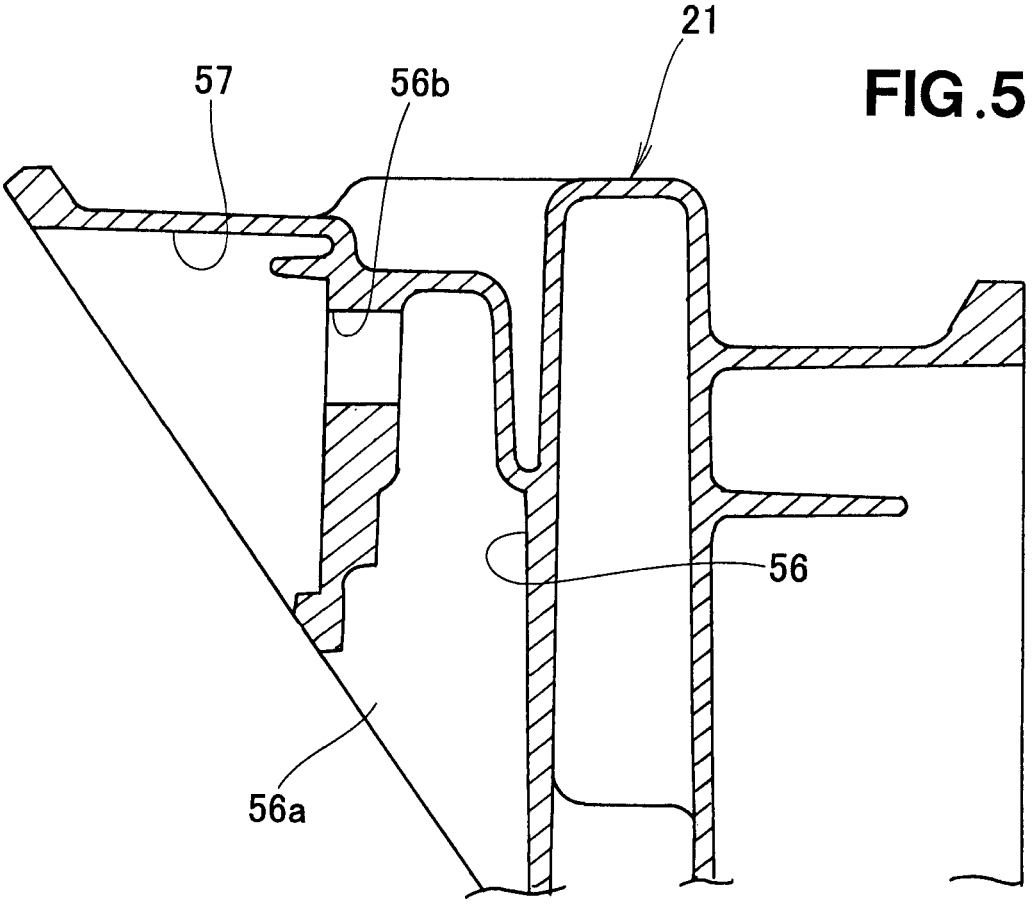
FIG. 5 is a sectional view taken along line 5-5 of FIG. 3.

As shown in FIG. 5, the first breather passage section 56 extends substantially vertically when the engine 21 is in the vertically upright position P1 (see FIG. 3), and it has an inlet end portion 56*a* opening into the crankcase 35 and an outlet end portion 56*b* opening into the second breather passage section 57. When the engine 21 is in the laterally laid-down position P2 (see FIG. 9), the lubricating oil 37 can enter the first breather passage section 56.

Referring back to FIG. 3, the second breather passage section 57 extends substantially horizontally when the engine 21 is in the vertically upright position P1. The second breather passage section 57 has an entry portion 62 through which the lubricating oil 37 can enter the passage section 57 when the engine 21 is in the laterally laid-down position P2 (see FIG. 9).

The entry portion 62 has a sub return passage 63, which communicates between the entry portion 62 and the crankcase 35 to return the lubricating oil 37, having entered the second breather passage section 57, back to the crankcase 35.

The first breather passage section 56 and the entry portion 62 of the second breather passage section 57 together constitute an oil entry portion 61 (i.e., inlet end portion of the breather passage 51 opening into the crankcase 35) which the lubricating oil 37 can enter when the engine 21 is placed in the laterally laid-down position P2. When the power generator 10 is in the vertically upright position P1, the oil entry portion 61 is located over the lubricating oil 37, i.e. above the fluid level 37*a* of the lubricating oil 37.

Figure 6:
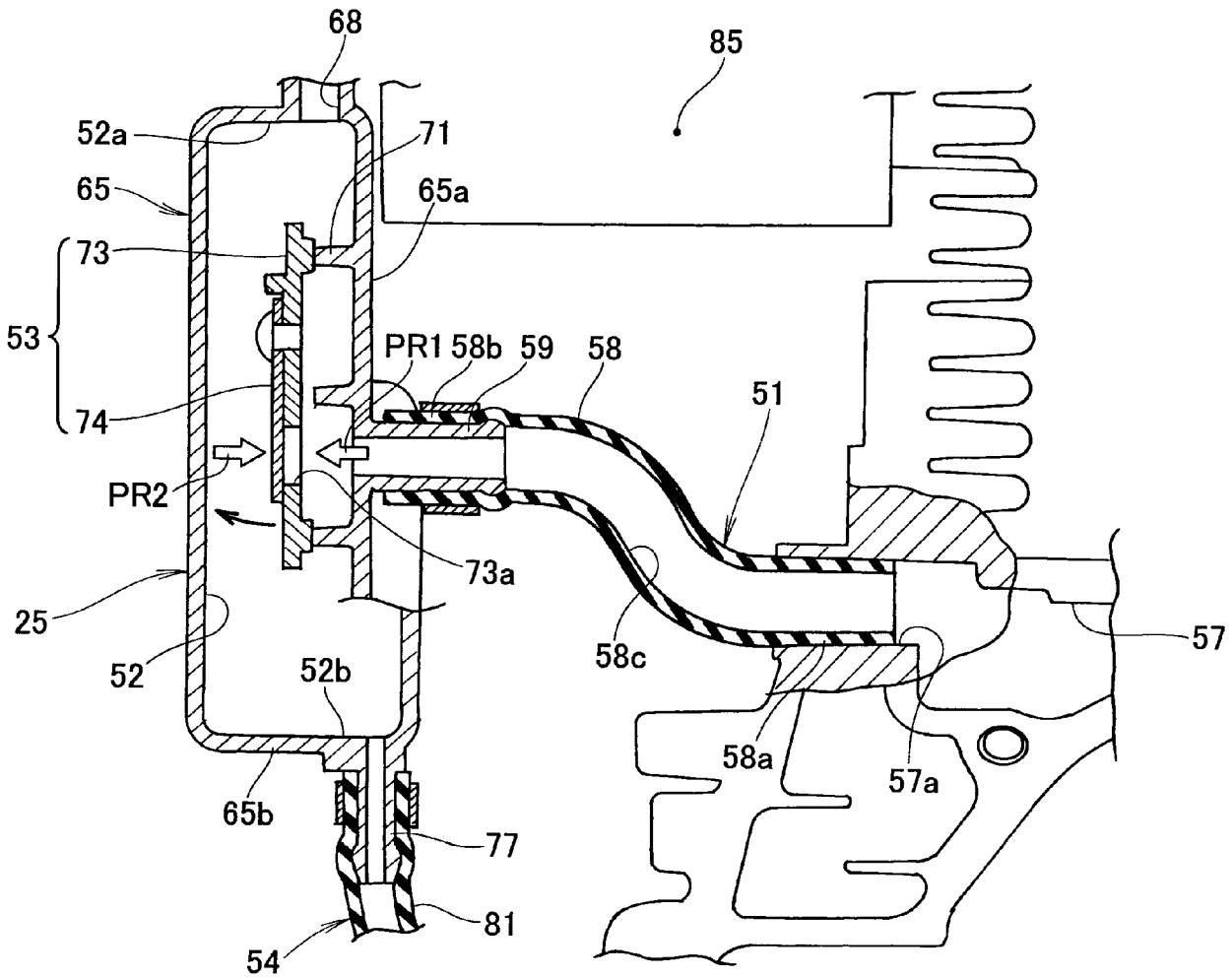
FIG. 6 is an enlarged sectional view of a section depicted at 6 in FIG. 3.

As shown in FIGS. 3 and 6, the third breather passage 58 has an inlet end portion 58*a* communicating with an outlet end portion 57*a* of the second breather passage section 57, and an outlet end portion 58*b* communicating with the inlet end portion 59 of the breather chamber 52.

The third breather passage 58 is of a generally crank shape such that, when the engine 21 is in the vertically upright position P1, the third breather passage 58 extends substantially horizontally with the outlet end portion 58*b* located above the inlet end portion 58*a*.

Figure 7A:
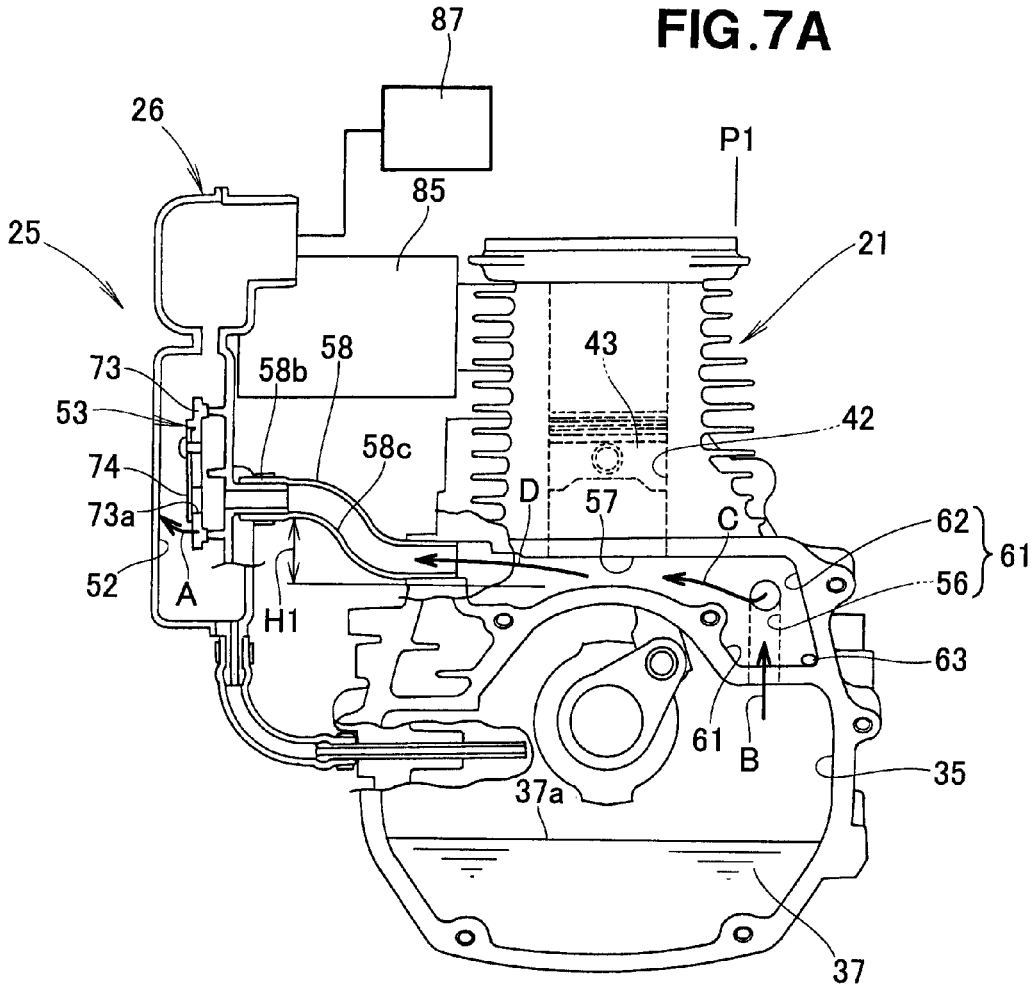
FIGS. 7A and 7B are views explanatory of an example manner in which the breather mechanism according to the first embodiment directs blow-by gas out of a crankcase.

Namely, the third breather passage section 58 has a stepped portion 58*c* such that the outlet end portion 58*b* of the third breather passage section 58 is located higher than the oil entry portion 61 by a height H1 (see FIG. 7A).

The lubricating oil 37 has a greater specific gravity than the blow-by gas. Thus, the lubricating oil 37 cannot be lifted up to the outlet end portion 58*b* by the blow-by gas directing the lubricating oil 37. In this way, it is possible to prevent the lubricating oil 37 from entering the breather chamber 52.

Figure 9:
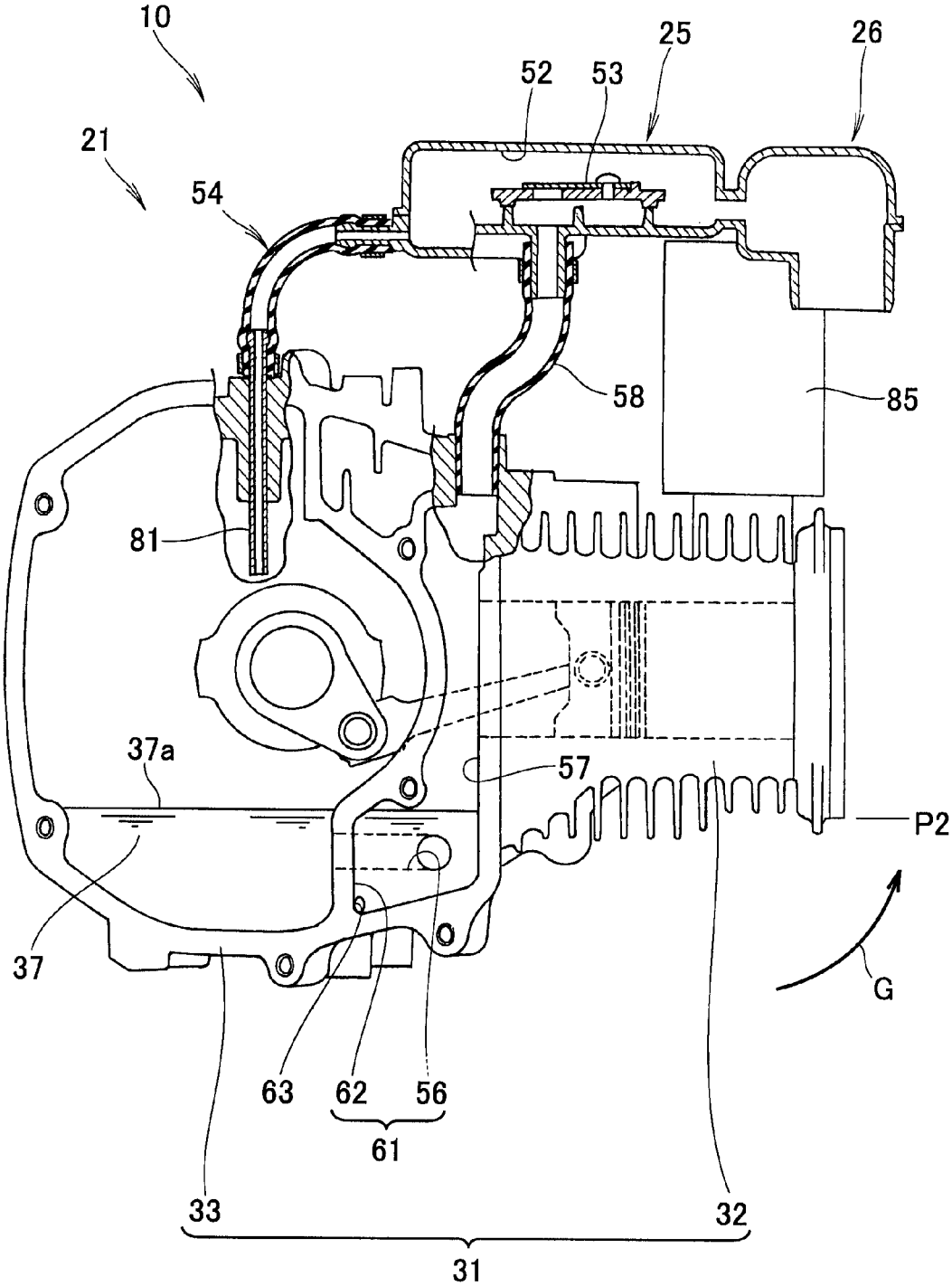
FIG. 9 is a view explanatory of an example manner in which the breather mechanism according to the first embodiment behaves when the power generator and hence the engine is retained in a forward laterally-laid-down position.

The breather chamber 52 is defined in a breather case 65 of a substantially rectangular parallelepiped shape. The breather chamber 52 is in communication with the crankcase 35 via the breather passage 51 and has an upper end portion 52*a* communicating with a lower end portion 67*a* of an air inlet chamber 67 via a communication passage 68. When the power generator 10 is retained in the forward laterally laid-down position P2, as shown in FIG. 9, the breather chamber 52 is located above the engine block 31 and hence the crankcase 35.

The inlet end portion 59 projects from the front surface of an inner wall portion 65*a* of the breather case 65 toward the engine block 31, and it opens into a substantially middle interior portion of the breather chamber 52. The outlet end portion 58*b* of the third breather passage section 58 is in communication with the inlet end portion 59.

Further, a valve mounting portion 71 is formed on the reverse or back surface of the inner wall portion 65*a* of the breather case 65, and the breather valve 53 disposed on the inlet end portion 59 of the breather chamber 52 is mounted to the valve mounting portion 71.

As shown in FIGS. 4 and 6, the breather valve 53 is a lead valve that includes a valve seat 73 attached to the valve mounting portion 71 and a valve body 74 73.

The valve body 74 of the breather valve 53 has an upper end portion attached to the valve seat 73, and a lower end portion closing a valve passage 73*a* of the valve seat 73. Namely, with the lower end portion of the valve body 74 kept in contact with a surface of the valve seat 73, the breather valve 53 is normally kept in a closed state.

Once the inner pressure of the crankcase 35 exceeds a predetermined value so that a pressure difference ΔP between a primary-side pressure (i.e., front-side pressure) PR1 and a secondary-side pressure (i.e., back-side pressure) PR2 exceeds a predetermined setting value, the valve body 74 moves, as indicated by a black arrow in FIG. 6, to thereby open the valve passage 73*a* of the valve seat 73. By the valve passage 73*a* being opened like this, the blow-by gas of the crankcase 35 flows into the breather chamber 52 through the breather passage 51.

As shown in FIGS. 3 and 6, a return outlet end portion 77 is formed on a bottom portion 65*b* of the breather case 65 to project downward from the bottom portion 65*b* of the breather case 65, and this return outlet end portion 77 opens into a lower end portion 52*b* of the breather chamber 52.

The main return passage 54 is in communication with the return outlet end portion 77. The main return passage 54 includes a first return passage section 81 provided substantially horizontally in the case section 33 of the engine block 31, and a second return passage section 82 communicating at one end with the first return passage section 81 and at the other end with the return outlet end portion 77. Thus, the lower end portion 52*b* of breather chamber 52 is in communication with the crankcase 35 via the main return passage 54.

The first return passage section 81 is attached substantially horizontally to a rear wall portion 33*a* of the case section 33 and has a distal end portion 81*a* projecting forwardly beyond the rear wall portion 33*a* by a length L1.

Figure 11:
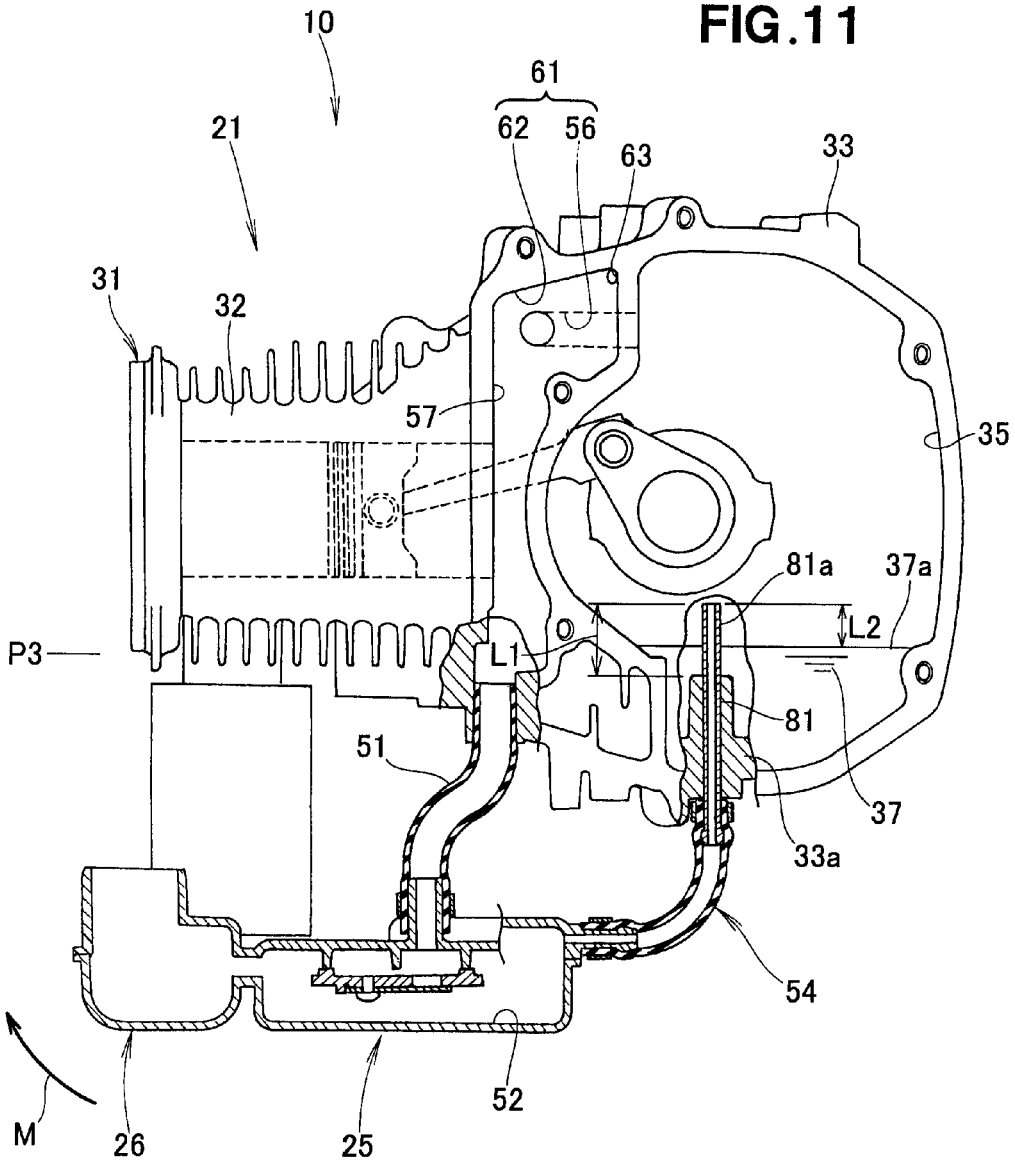
FIG. 11 is a view explanatory of an example manner in which the breather mechanism according to the first embodiment behaves when the power generator and hence the engine is retained in a backward laterally-laid-down position.

Thus, when the power generator 10 is brought down to a backward laterally-laid-down position P3 as shown in FIG. 11, the distal end portion 81*a* of the first return passage section 81 projects upwardly beyond the fluid level 37*a* of the lubricating oil 37 by a length L2. When the power generator 10 is in the vertically upright position P1, the first return passage section 81 extends substantially horizontally and is located above the fluid level 37*a* of the lubricating oil 37.

In the breather mechanism 25, the breather valve 53 opens once the inner pressure of the crankcase 35, i.e. the pressure of the blow-by gas of the crankcase 35, exceeds the predetermined value. Such opening of the breather valve 53 allows the blow-by gas of the crankcase 35 and the lubricating oil 37, having entered the oil entry portion 61, to be directed into (i.e. to flow into) the breather chamber 52 through the breather passage 51.

Because the breather chamber 52 has a greater space than the breather passage 51, the flow speed of the blow-by gas having flown into the breather chamber 52 would decrease, so that the residual lubricating gas 37 having flown into the breather chamber 52 together with the blow-by gas can be separated from the blow-by gas. The blow-by gas from which the lubricating gas 37 has been separated is sucked from the breather chamber 52 into the air inlet chamber 67 through the communication passage 68. Meanwhile, the lubricating gas 37, having been separated from the blow-by gas, drops down to the lower portion 52*b* of the breather chamber 52 and then is returned to the crankcase 35 through the main return passage 54.

As shown in FIGS. 3 and 4, the air intake system 26 includes: the air inlet chamber 67 communicating with the upper end portion 52*a* of the breather chamber 52 via the communication passage 68; an air-fuel mixer 85 communicating with the air inlet chamber 67 via a communication passage 84; and an air cleaner 87 communicating with the air inlet chamber 67 via a communication passage 86. External air is sucked from the air cleaner 87 into the air inlet chamber 67, and the blow-by gas is sucked from the breather chamber 52 into the air inlet chamber 67.

The mixer 85 has an inlet portion communicating with the air inlet chamber 67 and a fuel supply path (not shown), and an outlet portion communicating with the combustion chamber of the cylinder section 32. The air-fuel mixer 85 mixes together the air and blow-by gas, sucked from the air inlet chamber 67, and fuel sucked from the fuel supply path (not shown), and then it can direct a resultant mixture of the air and blow-by gas and fuel to the combustion chamber of the cylinder section 32.

Figure 7B:
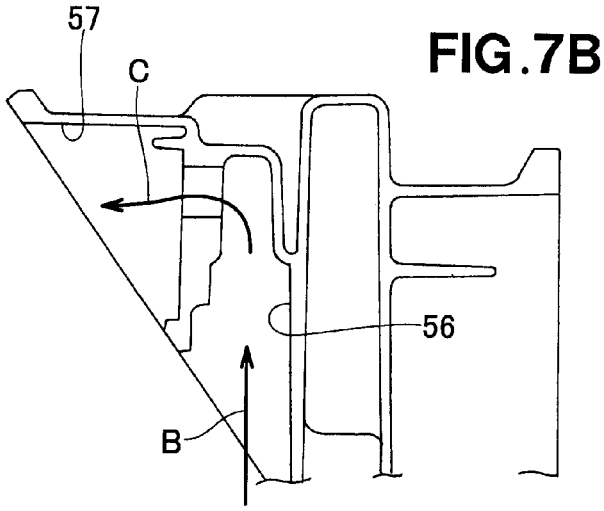
Figure 8:
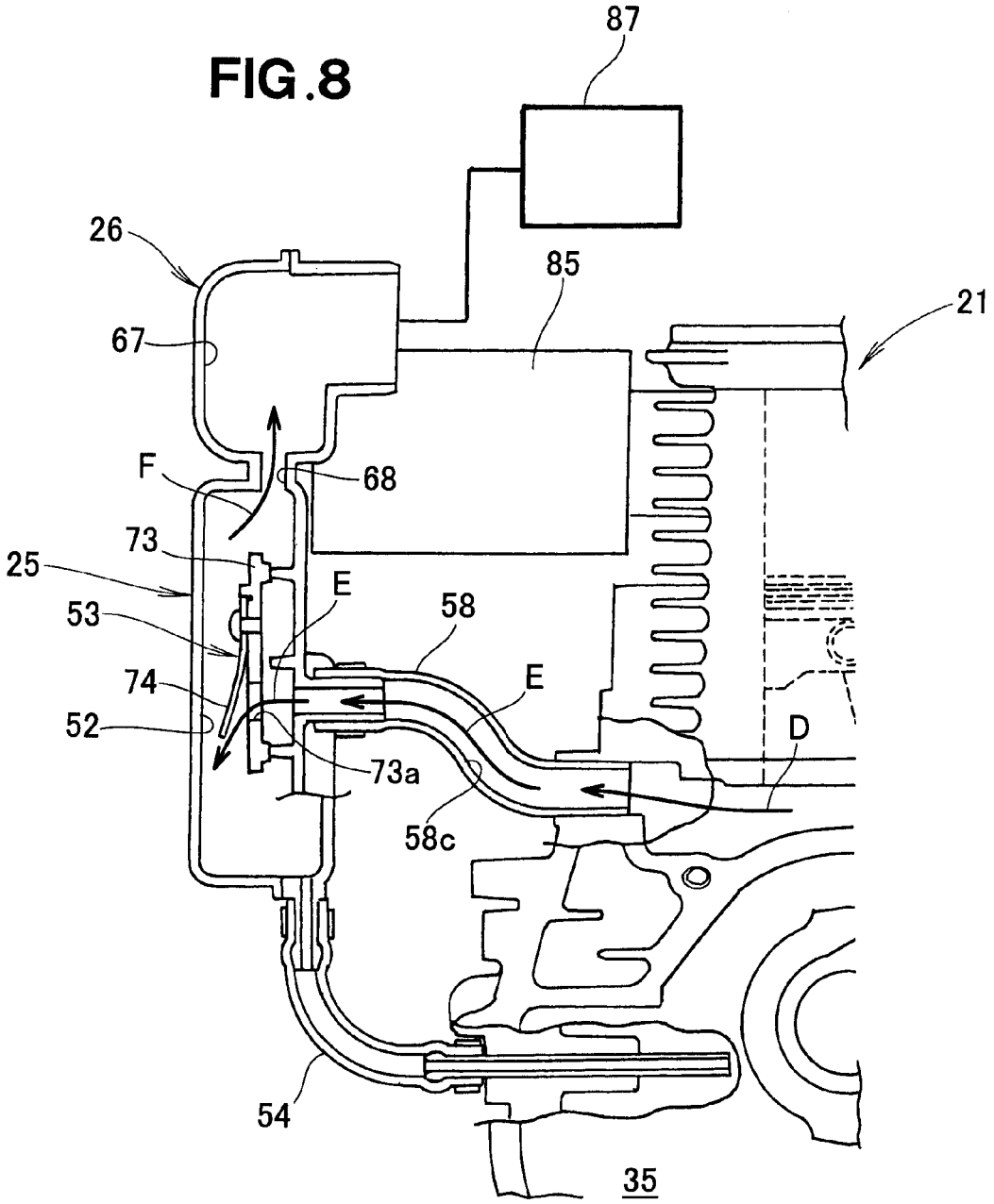
FIG. 8 is a view explanatory of an example manner in which the breather mechanism according to the first embodiment directs the blow-by gas to a breather chamber.

The following describe an example manner in which the breather mechanism 25 directs the blow-by gas of the crankcase 35 to the breather chamber 52, i.e. allows the blow-by gas to escape to the breather chamber 52, with reference to FIGS. 7 and 8. As shown in FIG. 7A, gas of the combustion chamber flows through the gap between the cylinder 42 and the piston 43 into the crankcase 35 as blow-by gas as the engine 21 is driven. Once the inner pressure of the crankcase 35, i.e. the pressure of the blow-by gas of the crankcase 35, exceeds the predetermined value, the valve body 74 of the breather valve 53 pivotally moves as indicated by arrow A, so that the valve passage 73*a* is opened.

In response to such opening of the valve passage 73*a* of the breather valve 53, the blow-by gas of the crankcase 35 flows through the first breather passage section 56 as indicated by arrow B and then flows into the second breather passage section 57 as indicated by arrow C, as clearly seen in FIG. 7B.

Referring back to FIG. 7A, the blow-by gas having flown into the second breather passage section 57 further flows into the third breather passage section 58 via the second breather passage section 57, as indicated by arrow D.

As shown in FIG. 8, the blow-by gas, having flown through the third breather passage section 58, flows into the breather chamber 52 via the opened breather valve 53 (valve passage 73*a*), as indicated by arrow E. Then, the blow-by gas, having flown into the breather chamber 52, is sucked into the air inlet chamber 67 via the communication passage 68, as indicated by arrow F.

As set forth above in relation to FIGS. 7 and 8, the breather mechanism 25 can direct the blow-by gas of the crankcase 35 into the air inlet chamber 67 by way of the breather chamber 52 and further direct efficiently the blow-by gas into the combustion chamber of the cylinder section 32 by way of the mixer 85.

Figure 10:
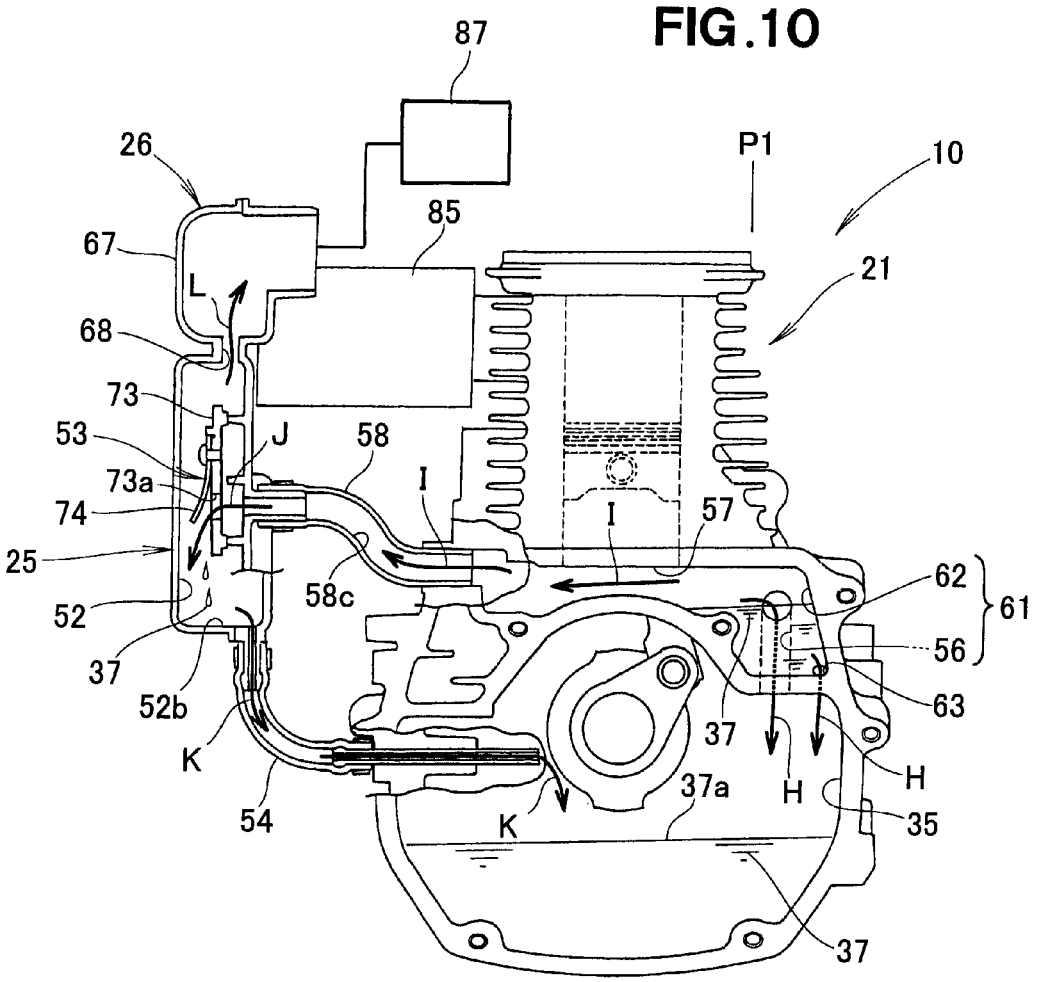
FIG. 10 is a view explanatory of an example manner in which the breather mechanism employed according to the first embodiment behaves when the engine is placed in a vertically upright position back from the forward laterally-laid-down position.

The following describe an example manner in which the breather mechanism 25 behaves when the power generator 10 (and hence the engine 21) is retained in the forward laterally-laid-down position P2, with reference to FIGS. 9 and 10. The power generator 10 is retained in the forward laterally-laid-down position P2 with the engine 21 in the deactivated state, as shown in FIG. 9 and FIG. 2 as well. When the power generator 10 is in the forward laterally-laid-down position P2 like this, the oil entry portion 61 (i.e., first breather passage section 56 and the entry portion 62 of the second breather passage section 57) is located below the fluid level 37*a* of the lubricating oil 37. Namely, the oil entry portion 61 is immersed in the lubricating oil 37, so that the lubricating oil 37 enters the oil entry portion 61.

Further, when the power generator 10 is in the forward laterally-laid-down position P2, the breather chamber 52 is located above the engine block 31. Thus, the lubricating oil 37, having entered the oil entry portion 61, can be prevented from entering the breather chamber 52.

Furthermore, the first return passage section 81 of the main return passage 54 is located above the fluid level 37*a* of the lubricating oil 37. Thus, the lubricating oil 37 can be prevented from entering the first return passage section 81. When the power generator 10 is to be used, the power generator 10 is brought from the forward laterally-laid-down position P2 back to the vertically upright position P1 as indicated by arrow G.

When the power generator 10 is back in the vertically upright position P1, the oil entry portion 61 is located above the fluid level 37*a* of the lubricating oil 37, as shown in FIG. 10. Thus, the lubricating oil 37, having entered the oil entry portion 61, is returned to the crankcase 35 by way of the first breather passage 51 and sub return passage 63 as indicated by arrow H.

The engine 21 may sometimes be driven after (particularly, immediately after) the power generator 10 is returned from the laterally laid-down position to the vertically upright position. In such a case, the engine 21 may sometimes be driven before all of the lubricating oil 37, having entered in the oil entry portion 61, is returned to the crankcase 35. In response to the engine 21 being driven like this, the valve body 74 of the breather valve 53 operates to open the valve passage 73*a*, and thus, the blow-by gas flows from the crankcase 35 into the oil entry portion 61. Thus, the lubricating oil 37, staying in the oil entry portion 61, flows into the third breather passage section 58 by way of the second breather passage section 57, as indicated by arrow I, together with the blow-by gas having flown into the oil entry portion 61.

As noted above, the third breather passage section 58 has the stepped portion 58*c* such that the outlet end portion 58*b* of the third breather passage section 58 is located higher than the oil entry portion 61 by the height H1 (see FIG. 7A). Furthermore, the lubricating oil 37 has a greater specific gravity than the blow-by gas. Thus, the lubricating oil 37 cannot be lifted up to the outlet end portion 58*b* by the blow-by gas directing the lubricating oil 37. As a consequence, a portion of the residual lubricating oil 37, having flown into the third breather passage section 58, is prevented by the stepped portion 58*c* from flowing into the breather chamber 52.

That portion of the residual lubricating oil 37, having been prevented from flowing into the breather chamber 52, is returned to the crankcase 35 by way of the second breather passage section 57 and sub return passage 63 as indicated by arrow H.

Meanwhile, the remaining portion of the residual lubricating oil 37 is directed, together with the blow-by gas, to the outlet end portion 58*b* by way of the stepped portion 58*c*, from which it flows into the breather chamber 52 via the opened breather valve 53 as indicated by arrow J.

Because the breather chamber 52 has a greater space than the breather passage 51, the flow speed of the blow-by gas having flown into the breather chamber 52 would decrease, so that the residual lubricating gas 37 having flown into the breather chamber 52 together with the blow-by gas is separated from the blow-by gas and drops down to the lower portion 52*b* of the breather chamber 52. The residual lubricating gas 37, having dropped down to the lower portion 52*b*, is returned to the crankcase 35 through the main return passage 54 as indicated by arrow K in FIG. 10.

The blow-by gas, having flown through the third breather passage section 58, flows, together with the residual lubricating gas 37, into the breather chamber 52 via the opened breather valve 53 as indicated by arrow J, where the blow-by gas is separated from the residual lubricating gas 37. The blow-by gas, having been separated from the residual lubricating gas 37, is sucked from the breather chamber 52 into the air inlet chamber 67 via the communication passage 68 as indicated by arrow L.

As set forth above in relation to FIGS. 9 and 10, when the power generator 10 is retained in the forward laterally-laid-down position P2, the breather chamber 52 of the breather mechanism 25 is located above the engine block 31, so that the lubricating oil 37 can be prevented from entering the breather chamber 52 via the breather passage 51. Stated differently, when the power generator 10 is retained in the forward laterally-laid-down position P2, the breather mechanism 25 can prevent, by means of the breather passage 51, the lubricating oil 37 from entering the breather chamber 52.

Further, when the power generator 10 is retained in the forward laterally-laid-down position P2, the first return passage section 81 of the main return passage 54 is located above the fluid level 37*a* of the lubricating oil 37. Thus, the lubricating oil 37 can be prevented from entering the breather chamber 52 by way of the main return passage 54.

In addition, by the provision of the stepped portion 58 of the third breather passage section 58 and the breather chamber 52, the breather mechanism 25 can prevent the lubricating oil 37, staying in the oil entry portion 61, from being sucked into the air intake system 26. Thus, the breather mechanism 25 can prevent the lubricating oil 37, staying in the oil entry portion 61, from being sucked into the combustion chamber of the cylinder section 32 as the engine 21 is driven after having been returned to the vertical upright position P1.

The following describe an example manner in which the breather mechanism 25 behaves when the power generator 10 is retained in the backward laterally-laid-down position P3 where it lies on its back side, with reference to FIG. 11. The power generator 10 is retained in the backward laterally-laid-down position P3 with the engine 21 in the deactivated state, as shown in FIG. 11. When the power generator 10 is in the backward laterally-laid-down position P3 like this, the breather chamber 52 is located below the engine block 31 and hence the crankcase 35.

Thus, the oil entry portion 61 (i.e., first breather passage section 56 and the entry portion 62 of the second breather passage section 57) is located above the fluid level 37*a* of the lubricating oil 37. The oil entry portion 61 constitutes an inlet end portion of the breather passage 51 opening into the crankcase 35. With the oil entry portion 61 located above the fluid level 37*a* of the lubricating oil 37, the lubricating oil 37 can be prevented from entering the oil entry portion 61.

Further, the first return passage section 81 of the main return passage 54 has its distal end portion 81*a* projecting forwardly beyond the rear wall portion 33*a* by the length L1. Thus, when the power generator 10 is brought down to the backward laterally-laid-down position P3 as shown in FIG. 11, the distal end portion 81*a* of the first return passage section 81 can project upwardly beyond the fluid level 37*a* of the lubricating oil 37 by the length L2. Therefore, the lubricating oil 37 can be prevented from entering the first return passage section 81.

In the aforementioned manner, the breather mechanism 25 can prevent the lubricating oil 37 from entering the oil entry portion 61 and entering the first return passage section 81, to thereby reliably prevent the lubricating oil 37 from entering the breather chamber 52.

When the power generator 10 is to be used, the power generator 10 is brought from the backward laterally-laid-down position P3 back to the vertically upright position P1 as indicated by arrow M. After the power generator 10 is brought back to the vertically upright position P1, the engine 21 is driven, so that the blow-by gas of the crankcase 35 can be directed to the breather chamber 52 by way of the breather passage 51 and breather valve 53. Then, the blow-by gas, having flown into the breather chamber 52, can be directed to the combustion chamber of the cylinder section 32 by way of the mixer 85.

When the power generator 10 is in the backward laterally-laid-down position P3, the oil entry portion 61 is located above the fluid level 37*a* of the lubricating oil 37 as set forth above in relation to FIG. 11, and thus, the lubricating oil 37 can be prevented from entering the oil entry portion 61 (breather passage 51) and hence from the breather chamber 52.

Stated differently, when the power generator 10 is retained in the backward laterally-laid-down position P3, the breather mechanism 25 can prevent, by means of the breather passage 51, the lubricating oil 37 from entering the breather chamber 52.

Further, when the power generator 10 is in the backward laterally-laid-down position P3, the distal end portion 81*a* of the first return passage section 81 projects upwardly beyond the fluid level 37*a* of the lubricating oil 37, and thus, the lubricating oil 37 can be prevented from entering the breather chamber 52 via the main return passage 54. In addition, the lubricating oil 37 can be prevented from being sucked into the combustion chamber of the cylinder section 32 as the engine 21 is driven in the vertical upright position P1.

Figure 12:
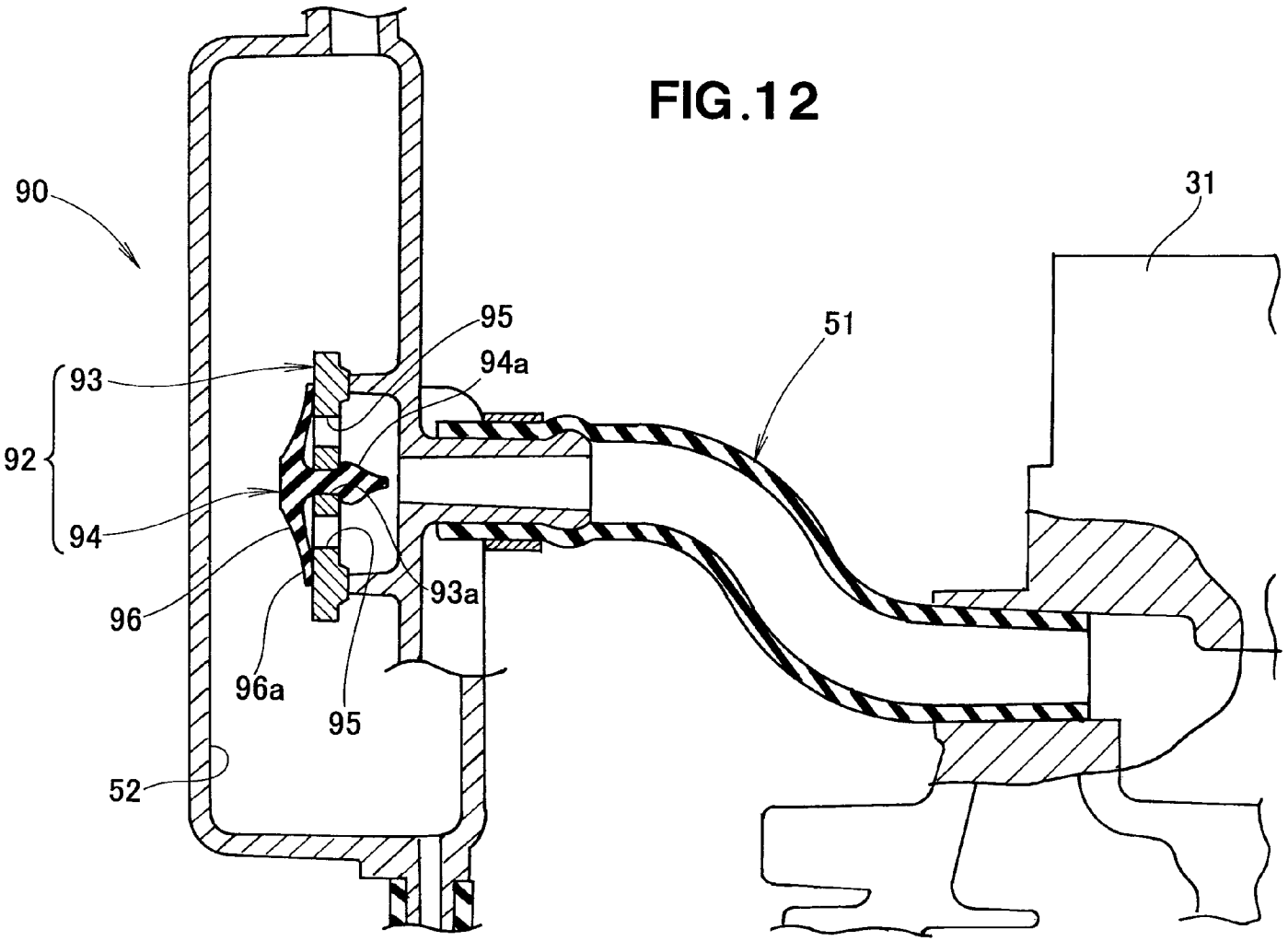
FIG. 12 is a sectional view showing a breather mechanism according to a second embodiment of the present invention.
Figure 13:
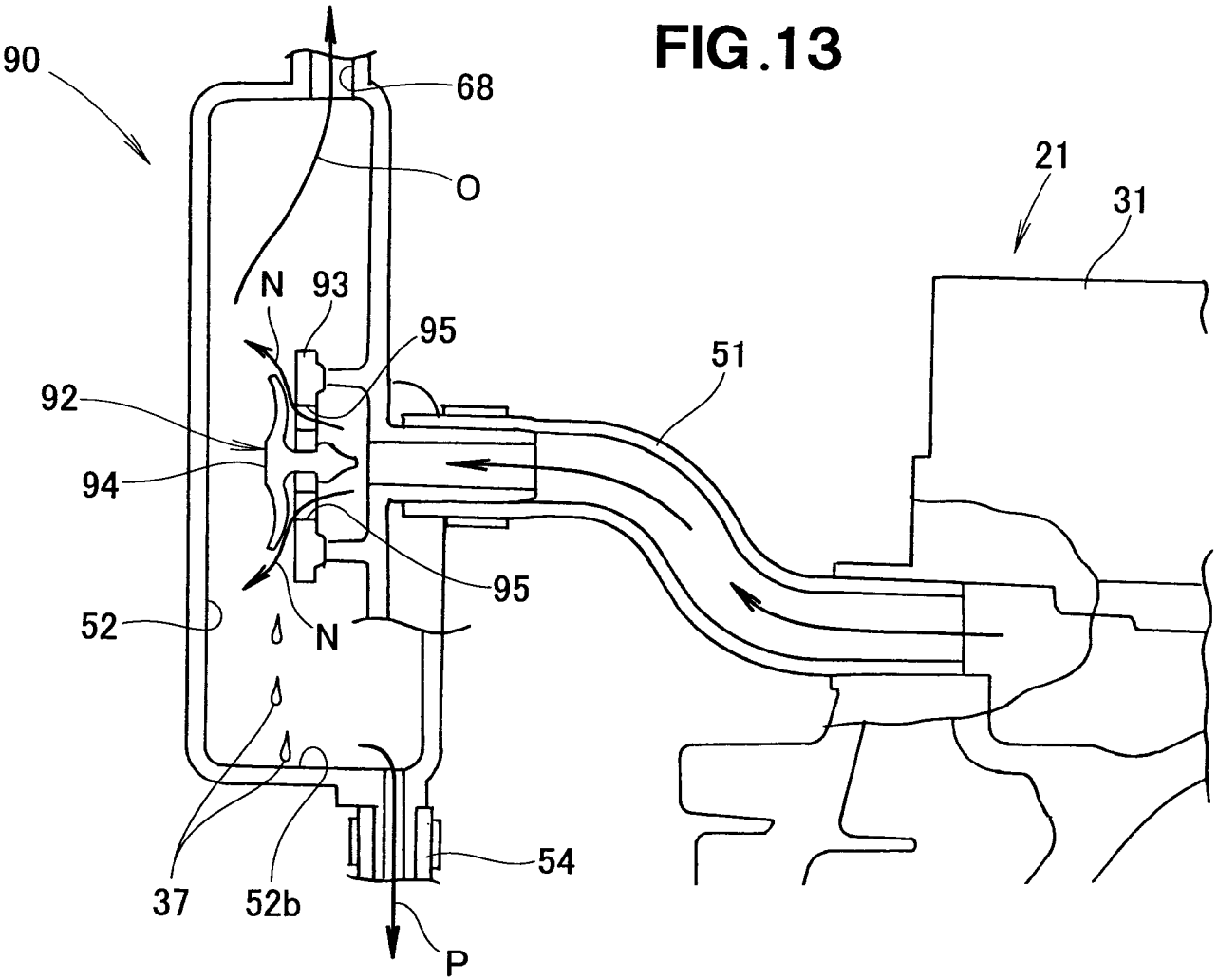
FIG. 13 is a view explanatory of an example manner in which the breather mechanism according to the second embodiment directs the blow-by gas of the crankcase to the breather chamber.

The following describe another or second embodiment of the breather mechanism 90 with reference to FIGS. 12 and 13. Similar elements to those in the first embodiment of the breather mechanism 25 are indicated by the same reference numerals and characters as used for the first embodiment and will not be described here to avoid unnecessary duplication.

As shown in FIG. 12, the second embodiment of the breather mechanism 90 includes a breather valve 92 constructed differently from the breather valve 53 employed in the first embodiment. The breather valve 92 includes a valve seat 93 mounted on the valve mounting portion 71 and a valve body 94 73.

The valve seat 93 has a mounting hole 93*a* formed substantially centrally therein, and valve passages 95 formed therein radially outwardly of the mounting hole 93*a*. A support shaft 94*a* of the valve body 94 is inserted through the mounting hole 93*a* of the valve seat 93.

The valve body 94 is formed of an elastic material and has a dome-shaped portion 96. The valve body 94 has a radially outer peripheral surface 96*a* held in contact with a surface of the valve seat 93. Namely, the breather valve 92 is a so-called umbrella valve which closes the valve passages 95 by the radially outer peripheral surface 96*a* of the dome-shaped portion 96 of the valve body 94 being held in contact with the valve seat 93 and which opens the valve passages 95 by the valve body 94 being elastically deformed so that the radially outer peripheral surface 96*a* is brought out of contact with the valve seat 93.

The breather valve 92 is normally kept closed, and it is opened once the inner pressure of the crankcase 35, i.e. the pressure of the blow-by gas of the crankcase 35, exceeds a predetermined value. Such opening of the breather valve 92 allows the blow-by gas of the crankcase 35 to be directed into (i.e. to flow into) the breather chamber 52 through the breather passage 51.

Because the valve body 94 is formed of the elastic material into a dome shape as noted above, it can be elastically deformed with a minute pressure. Thus, the breather valve 92 can be reliably deformed to open the valve passages 95 once the inner pressure of the crankcase 35 exceeds the predetermined value.

The following describe an example manner in which the second embodiment of the breather mechanism 90 directs the blow-by gas of the crankcase 35 to the breather chamber 52 through operation of the breather valve 92, with reference to FIG. 13. As shown in FIG. 13, once the inner pressure of the crankcase 35 (see FIG. 3) exceeds the predetermined value as the engine 21 is driven, the valve body 94 of the breather valve 92 is elastically deformed to open the valve passages 95. By the valve passages 95 being opened like this, the blow-by gas of the crankcase 35 and the lubricating oil 37 having entered the oil entry portion 61 flows into the breather chamber 52 by way of the breather passage 51 and breather valve 92 as indicated by arrow N.

Because the breather chamber 52 has a greater space than the breather passage 51, the flow speed of the blow-by gas having flown into the breather chamber 52 would decrease, so that the lubricating gas 37, having flown into the breather chamber 52 together with the blow-by gas, can be separated from the blow-by gas. The blow-by gas from which the lubricating gas 37 has been separated is sucked from the breather chamber 52 into the air inlet chamber 67 (see FIG. 3) through the communication passage 68 as indicated by arrow O. Meanwhile, the lubricating gas 37, having been separated from the blow-by gas, drops down to the lower portion 52*b* of the breather chamber 52 and is returned to the crankcase 35 (see FIG. 3) through the main return passage 54.

As set forth above in relation to FIGS. 12 and 13, the valve body 94 of the breather valve 92 is formed of the elastic material into the dome shape. Thus, the breather valve 92 can be reliably deformed so that the blow-by gas can be directed into the breather chamber 52 in an appropriate manner.

Further, the breather valve 92 employed in the second embodiment can achieve generally the same advantageous benefits as the breather valve 53 employed in the first embodiment.

It should be appreciated that the breather-mechanism-equipped engine 21 of the present invention may be modified variously as necessary without being limited to the above-described embodiments.

For example, whereas the first and second embodiments of the breather-mechanism-equipped engine 21 have been described above as applied to the power generator 10, the present invention is not so limited, and the breather-mechanism-equipped engine 21 of the present invention may be applied to other working machines than power generators.

Furthermore, the shapes and constructions of the power generator 10, engine 21, breather mechanism 25, crankcase 35, breather passage 51, breather chamber 52, breather valves 53 and 92, outlet end portion 58*b* of the breather passage 51, inlet end portion 59 of the breather chamber 52, oil entry portion 61, valve seats 73 and 93, valve bodies 74 and 94, etc. are not limited to the aforementioned and may be modified as necessary.

The basic principles of the present invention are particularly suited for application to engines in which lubricating oil is stored in a crankcase and which is equipped with a breather mechanism that causes blow-by gas of the crankcase to flow out of the crankcase.

What is claimed is:

1. An engine in which lubricating oil is stored in a crankcase and which is equipped with a breather mechanism for causing blow-by gas of the crankcase to flow out of the crankcase, the breather mechanism comprising:

a single breather passage opening into the crankcase;

a single breather chamber communicating with the crankcase via the single breather passage;

the breather passage having an outlet end portion, the breather chamber having an inlet end portion to which the outlet end portion of the breather passage is connected;

a breather valve provided at the inlet end portion of the breather chamber and configured to open to allow the blow-by gas to flow out of the crankcase into the breather chamber via the breather passage when an inner pressure of the crankcase exceeds a predetermined value;

the breather passage being directly connected to the breather chamber and the crankcase;

the breather passage being configured to prevent the lubricating oil from entering the breather chamber when the engine is placed in a laterally laid-down position;

the outlet end portion of the breather passage, opening into the breather chamber, being located above an inlet end portion of the breather passage, opening into the crankcase, when the engine is in a vertical upright position; and a return passage provided separately from the breather passage for returning the lubricating oil, having flown into the breather chamber through the breather passage, back to the crankcase, the return passage having one end portion connected to the breather chamber and an opposite end portion disposed within the crankcase, the opposite end portion of the return passage being always disposed above a level of the lubricating oil stored in the crankcase regardless of whether the engine is in the vertical upright position or in the laterally laid-down position.

2. The engine according to claim 1, wherein, the engine is configured such that the breather chamber is located above an engine block, and the inlet end portion of the breather passage is immersed in the lubricating oil stored in the crankcase, when the engine is in the laterally laid-down position lying on one side thereof.

3. The engine according to claim 1, wherein, the engine is configured such that the breather chamber is located below the engine block, and the inlet end portion of the breather passage is located above the lubricating oil stored in the crankcase, when the engine is in the laterally laid-down position lying on another side thereof opposite from the one side.

4. The engine according to claim 1, wherein the breather valve comprising:

a valve seat, and a valve body formed of an elastic material into a dome shape and mounted on the valve seat, the valve seat having a valve passage normally closed with the valve body, and wherein, when the inner pressure of the crankcase exceeds the predetermined value, the breather valve opens to allow the blow-by gas to flow out of the crankcase to the breather chamber.

5. The engine according to claim 1, further comprising:

a breather case defining said breather chamber; and a valve mounting portion formed on a back surface of an inner wall of the breather case, wherein the breather valve is mounted to the valve mounting portion.

6. An engine comprising:

an engine block having a crankcase in which lubricating coil is stored;

a breather mechanism for causing blow-by gas of the crankcase to flow out of the crankcase: and an air intake system provided in fluid communication with the breather mechanism, wherein the breather mechanism comprises:

a breather passage having an inlet end portion opening to the crankcase and an outlet end portion opposite to the inlet end portion;

a breather chamber communicating with the crankcase via the breather passage, the breather chamber having an inlet end portion to which the outlet end portion of the breather passage is connected;

a breather valve provided at the inlet end portion of the breather chamber and configured to open to allow the blow-by gas to flow out of the crankcase into the breather chamber via the breather passage when an inner pressure of the crankcase exceeds a predetermined value;

a breather case structurally independent from the engine block and formed separately from the engine block, the breather case defining the breather chamber and being provided with the breather valve; and a return passage provided separately from the breather passage for returning the lubricating coil, having flown into the breather chamber through the breather passage, back to the crankcase, the return passage having one end portion connected to the breather chamber and an opposite end disposed within the crankcase, the opposite end portion of the return passage being always disposed above a level of the lubricating coil stored in the crankcase regardless of whether the engine is in a vertical upright position or in a laterally laid-down position, wherein the air intake system includes an air inlet chamber for introducing therein external air, the air inlet chamber being defined by the breather case and communicating with the breather case such that the blow-by gas can be sucked from the breather chamber into the air inlet chamber.

7. The engine according to claim 6, wherein the breather passage includes a first breather passage section formed in the engine block and having an inlet end portion opening into the crankcase and an outlet end portion, a second breather passage formed in the engine block and having an inlet end portion connected with the outlet end portion of the first breather passage section and an outlet end portion, and the third breather passage section extending between the engine block and the breather case and having an inlet end portion connected with the outlet end portion of the second breather passage section and an outlet end portion connected to the inlet end portion of the breather chamber.

* * * * *